United States Patent [19]

Audesse

[11] Patent Number: 4,656,396

[45] Date of Patent: Apr. 7, 1987

[54] FLUORESCENT LAMP CIRCUIT BREAKER WITH LOW CONTACT RESISTANCE

[75] Inventor: Emery G. Audesse, Beverly, Mass.

[73] Assignee: GTE Products Corporation, Stamford, Conn.

[21] Appl. No.: 520,862

[22] Filed: Aug. 5, 1983

[51] Int. Cl.[4] ..... H01J 7/44; H01J 13/46; H01J 19/78; H01J 29/96

[52] U.S. Cl. ..... 315/73; 427/118; 174/50.61; 315/74; 337/26

[58] Field of Search ..... 427/118, 111; 174/50.61, 50.63; 315/73, 74; 337/24, 25, 26, 27

[56] References Cited

U.S. PATENT DOCUMENTS

| | | | |
|---|---|---|---|
| 2,446,277 | 8/1948 | Gordon | 174/50.63 |
| 2,450,130 | 9/1948 | Gordon | 174/50.63 X |
| 2,685,125 | 8/1954 | Hansen et al. | 174/50.63 X |
| 2,930,873 | 3/1960 | Lake et al. | 337/27 X |
| 4,097,779 | 6/1978 | Latassa | 315/73 |
| 4,156,831 | 5/1979 | Cassidy et al. | 315/73 |
| 4,171,519 | 10/1979 | Cassidy et al. | 337/27 |

OTHER PUBLICATIONS

"Materials and Techniques for Electron Tubes", by W. H. Kohl, General Telephone & Electronics Technical Series, May 1962, pp. 433–440.

*Primary Examiner*—Saxfield Chatmon

*Attorney, Agent, or Firm*—Thomas H. Buffton; Carlo S. Bessone

[57] ABSTRACT

A rapid-start fluorescent lamp includes a circuit breaker therein having a sealed glass bottle, a thermally sensitive bimetal switch within the glass bottle, a pair of electrical conductors sealed into and passing through the sealed bottle with one electrical conductor attached to the bimetal and the other electrical conductor contacting the bimetal with each of the pair of electrical conductors formed of Dumet wire plated with an electrically conductive metal whereby formation of insulative oxides on the electrical conductors is inhibited.

5 Claims, 2 Drawing Figures

| WIRE CONTACT RESISTANCE, OHMS | | | | |
|---|---|---|---|---|
| | PRESS-EDGE | 0.045" | 0.090" | 0.250 |
| UNBORATED | 0.006-2.0+ | 5.8-20.0 | 0.010-19.0 | 0.003-0.060 |
| NI-PLATED | 0.009-0.015 | 0.011-0.015 | 0.008-0.011 | 0.007-0.009 |

FLUORESCENT LAMP CIRCUIT BREAKER WITH LOW CONTACT RESISTANCE

CROSS REFERENCE TO OTHER APPLICATIONS

The following concurrently-filed applications relate to rapid-start fluorescent lamps and bimetal circuit breakers for fluorescent lamps: U.S. Ser. Nos. 520,866; 520,865; and 520,863.

TECHNICAL FIELD

This invention relates to rapid-start fluorescent lamps and more particularly to rapid start fluorescent lamps and to a low contact resistance circuit breaker suitable for utilization with such lamps.

BACKGROUND ART

Generally, the most commonly encountered fluorescent lamps are the so called "preheat" and "rapid-start" types of fluorescent lamp. In the "preheat" type of lamp, heater current flows through the lamp electrode during lamp ignition. Thereafter, an external voltage sensitive starter opens the electrical circuit to the lamp electrodes and heater current flow is discontinued. The "rapid-start" type of fluorescent lamp normally has a constant flow of heater current through each electrode not only during ignition but also during operation of the lamp. However, heater current flow during operation, as in the "rapid-start" lamp, is lost power which undesirably reduces the operational efficiency of the lamp.

Numerous suggestions have been made for enhancing the efficiency of "rapid-start" type fluorescent lamps. For example, U.S. Pat. Nos. 4,052,687; 4,097,779; 4,114,968; 4,156,831 and 4,171,519 which are all assigned to the Assignee of the present application, provide numerous configurations for enhanced operation of "rapid-start" type fluorescent lamps. Primarily, each provides a thermally responsive circuit breaker suitable for discontinuing heater current during operation of the fluorescent lamp.

Unfortunately, it has been found that problems still exist in spite of the enumerated advantages of the above-mentioned configurations. More specifically, it has been found that contact resistance of the electrical conductors of the circuit breaker configuration utilized in a rapid-start fluorescent lamp is a continuing but erratic area of problems. For example, the Dumet electrical conductors usually employed in such structures tend to oxidize in varying degrees during the process of sealing the glass envelopes of the circuit breaker structures. Thus, oxides on the electrical conductors not only inhibit good electrical contact between the conductor and the bimetal of a circuit breaker but also are deleterious to the attainment of accurate low voltage resistance measurements. In other words, good electrical contact to the electrical conductors external to the circuit breaker enclosed within a glass bottle is difficult to obtain because of the oxides developed thereon during the sealing of the glass bottle.

OBJECTS AND SUMMARY OF THE INVENTION

An object of the present invention is to provide an enhanced circuit breaker. Another object of the invention is to provide an enhanced "rapid-start" fluorescent lamp. Still another object of the invention is to increase the efficiency of a "rapid-start" fluorescent lamp. A further object of the invention is to improve the electrical contact and conductivity of a circuit breaker suitable for use in a "rapid-start" fluorescent lamp.

These and other objects, advantages and capabilities are achieved in one aspect of the invention by a circuit breaker having a thermally-sensitive bimetal within a glass bottle with a pair of electrical conductors sealed into and passing through the glass bottle with a meltable by-pass element short-circuiting the electrical conductors within the glass bottle and the electrical conductors formed from a metal-plated Dumet material.

BEST MODE FOR CARRYING OUT THE INVENTION

Figures 1, 2:
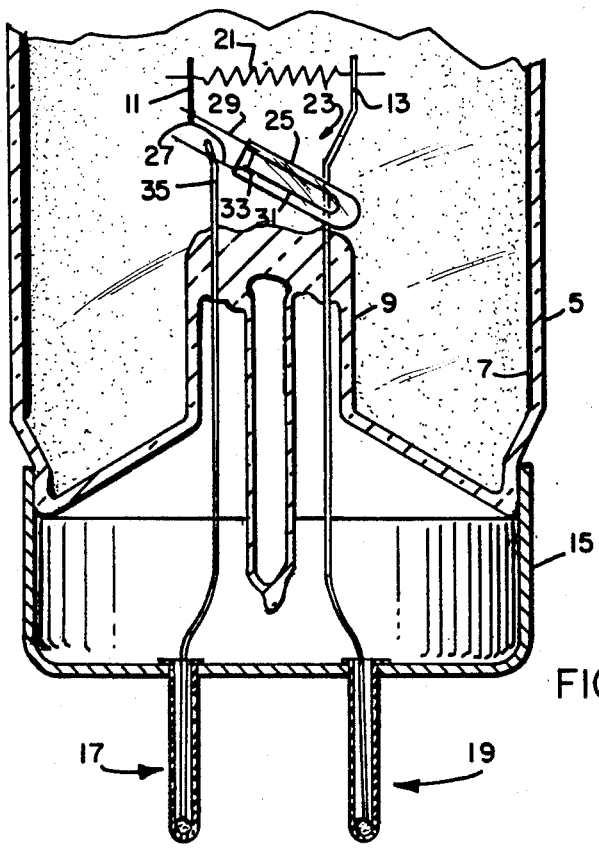
FIG. 1 is an elevational view, partly in section, of one end of a "rapid-start" fluorescent lamp having a circuit therein.
FIG. 2 is a chart comparing the resistance of unborated and nickel-plated Dumet wire in a circuit breaker of the invention.

For a better understanding of the present invention, together with other and further objects, advantages and capabilities thereof, reference is made to the following disclosure and appended claims in conjunction with the accompanying drawings.

Referring to FIG. 1 of the drawings, a rapid-start fluorescent lamp includes an elongated glass envelope 5 having a coating of phosphors 7 on the inner wall surface of the envelope 5. A glass stem member 9 is sealed into the end of the envelope 5 and includes a pair of electrical leads 11 and 13 sealed therein and passing therethrough. An end cap 15 is telescoped over and attached to the end of the glass envelope 5 and includes a pair of pins 17 and 19 electrically connected to a portion of the electrical leads 11 and 13 and formed to provide electrical connection to an external source (not shown). Moreover, the envelope 5 has a gas fill therein selected from the group consisting of argon, krypton, neon, helium and combinations thereof.

An electrode 21 is located within the envelope 5 and connected at opposite ends to the electrical leads 11 and 13. Thus, the longitudinal axis of the electrode 21 is in a direction substantially normal to the direction of the electrical leads 11 and 13. Moreover, this elctrode 21, which is frequently referred to as a filament or cathode, is of a well known type used in rapid start fluorescent lamps and usually includes a tungsten coil having a coating thereon in the form of alkaline earth oxides which were applied in the form of carbonates and processed to provide the oxides.

Disposed within the envelope 5 is a circuit breaker 23. The circuit breaker 23 is preferably in the form of a glass bottle 25 having a press seal at one end thereof. A pair of electrical conductors 27 and 29 are sealed into and pass through the press seal of the glass bottle 25. Also, a thermally-sensitive bimetal 31 is positioned within the glass bottle 25 with one end thereof attached to one of the electrical conductors 27 and the opposite end of the bimetal 31 contacting the other electrical conductor 29. Further, a conductive by-pass element 33, which is meltable in response to a short-duration high voltage pulse potential, shunts the bimetal 31 and is electrically connected to the electrical conductors 27 and 29. Moreover, the electrical conductors 27 and 29 extending outwardly of the glass bottle 25 are connected to the base pin 17 and to the electrical lead 11 respectively with the electrical lead 11 also connected to one end of the electrode 21.

As is well known in the art of sealing electrical conductors or leads into glass envelopes, it is a common practice to use a nickel-iron alloy coated with a thin layer of copper and known in the art as "Dumet." Such wire is especially effective for developing glass-to-metal seals with soft glass such as Corning glasses type 0010, 0080 and 0120, for example. Generally, heat is applied to the glass and to the "Dumet" in an amount sufficient to form an oxide layer on the "Dumet" which, in turn, serves as a bridge between the metal and the glass and insures the desired glass-to-metal seal.

In effecting the above-mentioned glass-to-metal sealing condition the developed oxide layer necessary to the sealing process has been found to be deleterious to good electrical contact to the electrical conductor or lead. Moreover, it has previously been mentioned that electrical contact of the circuit breaker 23 is effected by contact of the electrical conductor 29 and the bimetal 31. Thus, it has been found that rapid-start fluorescent lamps containing circuit breakers, dependent upon electrical contact with an electrical conductor or lead sealed into a glass envelope, are subject to inconsistent switch operation and erratic production testing due to variations in low resistance measurements of the electrical conductors when fabricated from a readily oxidized material such as "Dumet."

However, it has also been found that the above-described erratic resistance measurement variations and switch operation of such structures can be overcome by utilizing a metal-plated type of "Dumet" wire for the electrical conductors or leads. More specifically, it has been found that "Dumet" wire plated with a metal selected from the group consisting of nickel, platinum and rhodium provides improved electrical conductors, improved circuit breakers and improved rapid-start fluorescent lamps by reducing the above-mentioned erratic resistance measurement and switch operations. Specifically, nickel-plated "Dumet" wire having a diameter in the range of 0.010 to 0.025 is preferred because of the relatively low cost as compared with other metal-plated wires.

Referring to the chart of FIG. 2, a comparison of unborated "Dumet" and nickel-plated "Dumet" wire was made at the edge of the glass seal and at three other locations spaced from the glass seal or press edge. As can readily be seen, the nickel-plated wire has a resistance value lower than that of the borated "Dumet" in each instance. Thus, it can be seen that contact resistance of metal-plated wire is greatly reduced when borated and nickel-plated "Dumet" are compared.

While there has been shown and described what is at present considered the preferred embodiments of the invention, it will be obvious to those skilled in the art that various changes and modifications may be made therein without departing from the invention as defined by the appended claims.

What is claimed is:

1. A circuit breaker comprising a sealed glass bottle, a thermally-sensitive bimetal within said bottle, a pair of electrical conductors sealed into and passing through said glass bottle and an electrically-conductive by-pass element meltable in response to a short duration high voltage pulse potential shunting said pair of electrical conductors within said bottle, said electrical conductors formed of "Dumet" wire plated with an electrically conductive metal with one of said electrical conductors attached to said bimetal and the other electrical conductor electrically contacting said bimetal at room temperature and separated therefrom at temperatures higher than room temperature whereby formation of insulative oxides on said electrical conductors during glass bottle sealing is reduced.

2. The circuit breaker of claim 1 wherein said electrical conductors are in the form of Dumet wire plated with a material selected from the group consisting of platinum, rhodium and nickel.

3. The circuit breaker of claim 1 wherein said electrical conductors are formed of nickel-plated Dumet wire.

4. A rapid-start fluorescent lamp comprising a glass envelope having a phosphor-coated inner wall surface, a pair of spaced electrodes sealed into said glass envelope, a pair of electrically conductive leads sealed into and passing through said glass envelope and a circuit breaker disposed within said envelope with said circuit breaker having a sealed glass bottle, a pair of electrical conductors sealed into and passing through said bottle, said electrical conductors formed of Dumet wire and plated with a metal selected from the group consisting of nickel, platinum and rhodium with one of said pair of electrical conductors attached to said bimetal and the other one contacting said bimetal at room temperature and separated therefrom at temperatures higher than room temperature.

5. The rapid-start fluorescent lamp of claim 3 wherein said electrical conductors are nickel-plated Dumet wire.

* * * * *